US010048036B1

(12) United States Patent
Kempf et al.

(10) Patent No.: US 10,048,036 B1
(45) Date of Patent: Aug. 14, 2018

(54) PROJECTILE LAUNCHING DEVICE WITH SELF-TIMING AND WITHOUT CAM LEAN

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 15/795,292

(22) Filed: Oct. 27, 2017

Related U.S. Application Data

(63) Continuation-in-part of application No. 15/603,606, filed on May 24, 2017, now Pat. No. 9,829,268.

(51) Int. Cl.
*F41B 5/12* (2006.01)
*F41B 5/10* (2006.01)

(52) U.S. Cl.
CPC ..... *F41B 5/105* (2013.01); *F41B 5/123* (2013.01); *Y10S 124/90* (2013.01)

(58) Field of Classification Search
CPC .... F41B 5/10; F41B 5/105; F41B 5/12; F41B 5/123; Y10S 124/90
USPC ..... 124/25, 25.6, 900
See application file for complete search history.

(56) References Cited

U.S. PATENT DOCUMENTS 4,340,025 A * 7/1982 Caldwell ..... F41B 5/105 124/23.1
4,457,288 A 7/1984 Ricord
4,541,401 A * 9/1985 Caldwell ..... F41B 5/10 124/25.6
4,669,445 A * 6/1987 Schaar ..... F41B 5/10 124/25.6
6,470,870 B1 * 10/2002 Schaar ..... F41B 5/10 124/25.6
6,776,148 B1 * 8/2004 Islas ..... F41B 5/10 124/25.6
7,637,256 B2 * 12/2009 Lee ..... F41B 5/105 124/25.6
8,387,603 B2 * 3/2013 Darlington ..... F41B 5/10 124/23.1
8,651,095 B2 * 2/2014 Islas ..... F41B 5/105 124/25
8,833,349 B2 * 9/2014 Park ..... F41B 5/0094 124/25.6
8,881,714 B1 * 11/2014 Cooper ..... F41B 5/105 124/23.1
9,140,281 B1 * 9/2015 Schaar ..... F41B 5/105
9,310,155 B2 * 4/2016 Langley ..... F41B 5/105
(Continued)

*Primary Examiner* — Alexander Niconovich
(74) *Attorney, Agent, or Firm* — Donald J. Ersler

(57) ABSTRACT

A projectile launching device includes self-timing without cam lean. The projectile launching device may include a rail, a riser, two energy storing components, (such as two limbs), two cams, a launch string, and at least one cable. The ends of the launch string are attached to the two cams. Opposing ends of first and second cables may be coupled to the rail or riser. A mid-portion of the first and second cables are slideably engaged with the first and second cams, respectively. Alternatively, a single cable may replace the first and second cables. The two cams are preferably built as mirror images of each other at a centerline of the rail. The two cams include a launch string track, having identical, but mirrored, upper and lower cable tracks.

17 Claims, 21 Drawing Sheets

(56) References Cited

U.S. PATENT DOCUMENTS

| | | | | |
|---|---|---|---|---|
| 9,354,015 | B2 * | 5/2016 | Yehle | F41B 5/105 |
| 9,494,379 | B2 * | 11/2016 | Yehle | F41B 5/105 |
| 9,879,936 | B2 * | 1/2018 | Yehle | F41B 5/105 |
| 2016/0216058 | A1 * | 7/2016 | Sidebottom | F41B 5/10 |
| 2017/0038173 | A1 * | 2/2017 | Yehle | F41B 5/066 |
| 2017/0108307 | A1 * | 4/2017 | Yehle | F41B 5/066 |
| 2017/0122691 | A1 * | 5/2017 | Yehle | F41B 5/066 |
| 2017/0122695 | A1 * | 5/2017 | Yehle | F41B 5/1469 |

* cited by examiner

FIG 3B
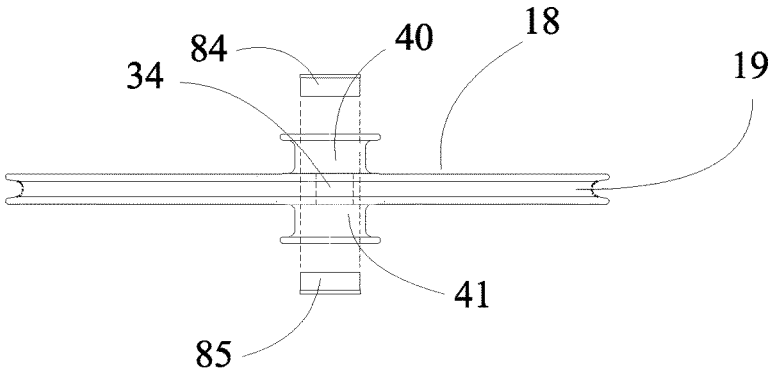
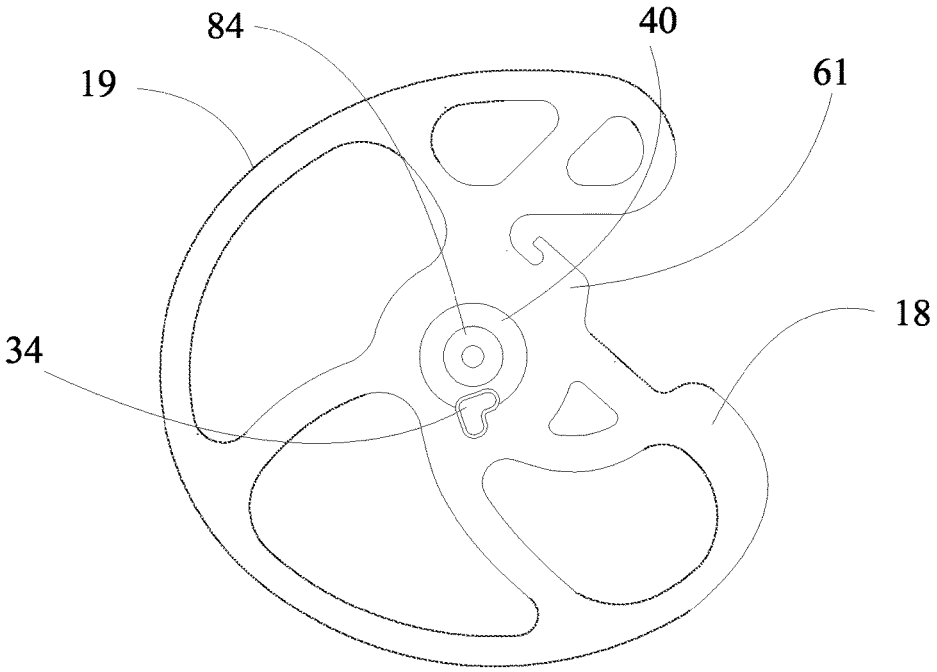
FIG 3A

FIG 3D
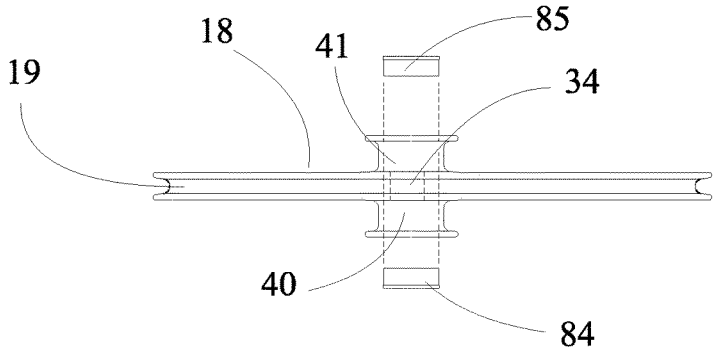
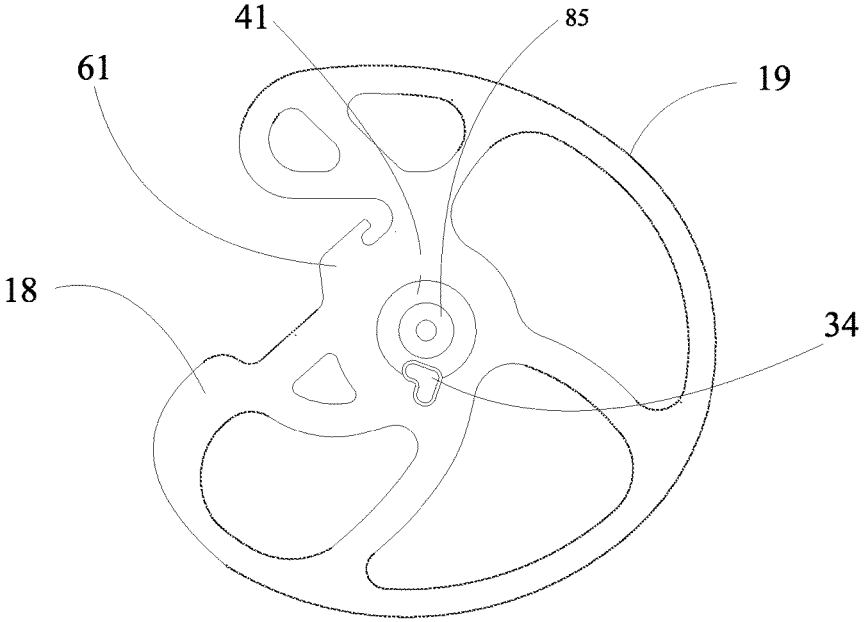
FIG 3C

FIG 3F
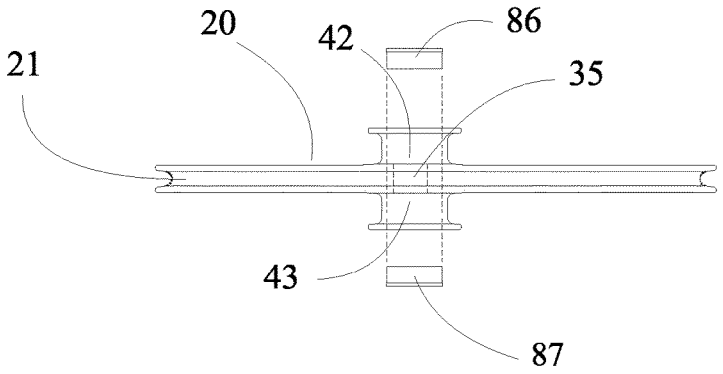
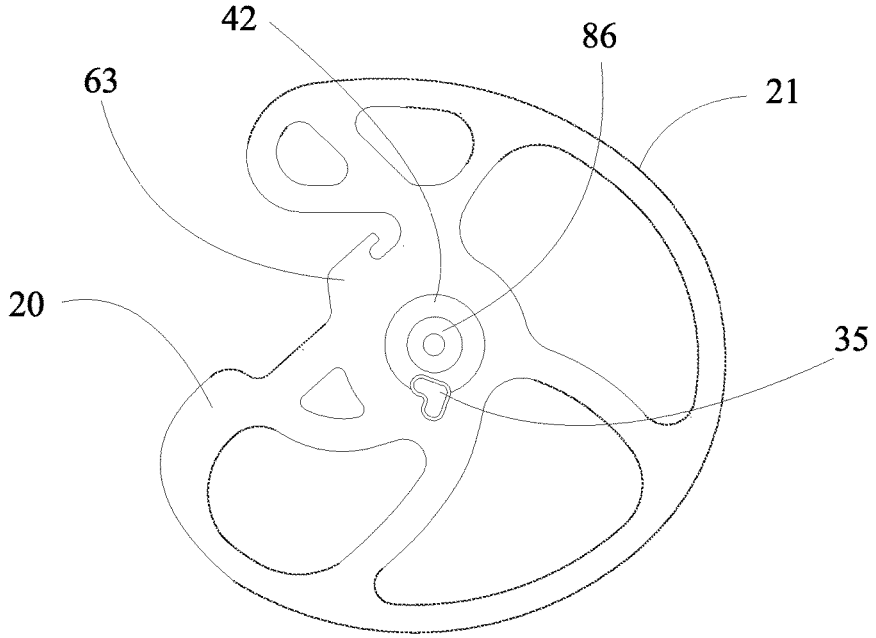
FIG 3E 22
21
20
72
77
32
46

22
21
20
72
77
32
46

44
31
70
75
18
19
22

44
31
70
75
18
19
22

PROJECTILE LAUNCHING DEVICE WITH SELF-TIMING AND WITHOUT CAM LEAN

CROSS-REFERENCES TO RELATED APPLICATIONS

This is a continuation-in-part patent claiming the benefit of application Ser. No. 15/603,606, filed on May 24, 2017.

BACKGROUND OF THE INVENTION

Field of the Invention

The present invention relates generally to archery and more specifically to a shooting bow with a unique cable arrangement, which allows a portion of first and/or second cables to be slidably engaged to first and second cams, and the ends of the cable(s) to be coupled back to first and second posts. This arrangement enables the device to have self-timing. The present invention may alternately use components other than flexible limbs for storing energy prior to launching the projectile.

Discussion of the Prior Art

Historically, archery bows and crossbows have been used for war, survival, sport, and recreation. A specific component of a compound style shooting bow are the cables. Typically, each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance related to cam lean, and/or assembly and cost. Due to the crossing of cables and the need to keep the cables from interfering with the flight of the arrow, the cables often are off-angle, which in turn creates twisting and torque in a cam axle, thus creating cam lean.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. U.S. Pat. No. 7,637,256 to Lee discloses a compound bow, which provides a shooting bow that removes the issue of cables interfering with the flight of the arrow. However, the inefficient use of tensioning devices severely limits the potential of this device. U.S. Pat. No. 8,651,095 to Islas discloses a bowstring cam arrangement for compound crossbow, which provides a method of removing the cables from the path of the string. U.S. Pat. No. 9,494,379 to Yehle discloses a crossbow, where Yehle relies on four cables. Issues are created by having separate cables above and below the string track on each cam. If the cables are not of exact length, or if the upper cable stretches more than the lower cable, or visa-versa, the cables must be adjusted by the user to stay in time with each other. Timing of the cables can be a time consuming and a very difficult process.

The above inventions try to keep four cables in proper timing, as opposed to two. The present invention deals with the manner in which the cables are coupled to the cams of the bow or crossbow.

Accordingly, there is a clearly felt need in the art to provide a shooting bow, which allows a mid-portion of first and second cables to be slidably engaged to first and second cams, and a first end of a cable coupled to a post above the plane of the launch string, and a second end of a cable coupled to a post below the plane of a shooting string, respectively. The cables do not cross the centerline of the shooting bow, or alternately a shooting bow with a launch string and having a single cable, which replaces two cables. Additionally, the cams are allowed to rotate 360 degrees due to a wider upper and lower cable track, or alternately a divided helical cable track, which allows the cable to wrap adjacent to itself.

SUMMARY OF THE INVENTION

The present invention provides a self-timing cam and cable configuration for a projectile launching device. The present invention includes at least one cable, which does not anchor to the cam(s), and also reduces or eliminates cam lean. The projectile launching device with self-timing and without cam lean (projectile launch device) may be applied to either a crossbow or vertical bow. The projectile launch device preferably includes a first cam, a second cam, a launch string and two cables, collectively known as a harness system, where neither end of the cable is anchored to a cam. This configuration allows opposing ends of a first cable to be anchored to first and second cable posts, and opposing end of a second cable to be anchored to third and fourth cable posts. Preferably, the first and second cables do not cross a centerline of the shooting bow. In a second preferred embodiment, the projectile launching device preferably includes a string latch housing, a bow riser, a rail, a first energy storing device (such as a first limb), a second energy storing device (such as a second limb), a first cam, a second cam, at least one bowstring, and two cables.

A third preferred embodiment uses a launch string and only one cable. One end of the cable is coupled to a first cable post, wherein a portion of the cable is slideably engaged with a first transitional portal; crosses to the second cam; another portion of the cable is slideably engaged with a second transitional portal; and an opposing end of the cable is coupled to the second cable post. The term "limb" may refer to what are known as solid limbs, split-limbs, tube-limbs, or any other flexible energy storing component. The bow riser is enjoined with the rail. One end of the first limb extends from a first end of the bow riser and one end of the second limb extends from a second end of the bow riser. The first cam is pivotally retained on the first limb and the second cam is pivotally retained on the second limb. A first end of the launch string is retained by the first cam and a second end of the launch string is retained by the second cam. A first set of first and second cable posts are located on a first side of a centerline of the rail and a second set of first and second cable posts are located on a second side of the centerline of the rail. The first cam includes a first cam launch string track, an upper first cam cable track, located above the launch string track, a first cam transitional portal, and a lower first cam cable track, located below the launch string track. The second cam includes a second cam launch string track, an upper second cam cable track, located above the launch string track, a second cam transitional portal, and a lower second cam cable track, located below the launch string track. The first set of first and second cable posts are located above the plane of the launch string, and the second set of first and second cable posts are located below the plane of the launch string.

A first end of the first cable is coupled to the first cable first cable post; a segment of the first cable before a middle of the first cable partially engages the first cam first cable track; the middle of the first cable partially wraps the first transitional portal; a segment of the first cable after the middle of the first cable partially engages the first cam second cable track; and a second end of the first cable is coupled to the first cable second cable post. A first end of the second cable is coupled to the second cable first cable post; a segment of the second cable before a middle of the second cable partially engages the second cam first cable track; the middle of the second cable partially wraps the second transitional portal; a segment of the second cable after the middle of the second cable partially engages the second cam second cable track; and a second end of the second cable is coupled to the second cable second cable post.

When the launch string is drawn from a rest position to a ready to fire position, the first cam rotates in a first direction and the second cam rotates in a second direction. As the first and second cams rotate, the launch string is unwound from the first and second launch string tracks. Simultaneously, the first and second cables wind into the first and second cable tracks of the first and second cams.

A unique feature of the present invention is that the first and second cables are not firmly fixed to the cams in any way, rather they "float" or slide relative to the first and second cam transitional portals. The first and second cables are of one piece, and as the cable stretches, it self-centers itself.

Another unique feature of the present invention is the ability of the cam to rotate a full 360 degrees, such that as the cams are rotating, the upper and lower cable portions wrap the cable pulleys.

In a preferred embodiment, the launch string may be releasably retained in the ready-to-fire position by mechanisms known as a string latch assembly or a string release. In a first preferred alternative embodiment, the launch string may be held in the ready-to-fire position and released by the users' fingers.

In a second preferred alternative embodiment, a rail-less crossbow design may be used.

In a third preferred alternative embodiment, the same harness system configuration may be used on projectile launching devices utilizing energy storing components other than flexible limbs. These other types of energy storing components include spring(s), hydraulics, or pressurized cylinder(s).

For clarity, the word coupled is being defined as a way to connect an object, such as a bowstring or cable, with another object, be it directly or indirectly, such as directly to a post or pulley, or indirectly as in from the end of a string or cable, to an intermediate object, and then to a limb or axle. The term "transitional portal" is the opening in the surface of the cam that the cable(s) is inserted, to allow the cable to transition from a first side of the cam to the second side of the cam, said transitional portal also confines and restricts the movement of the cable(s)

Accordingly, there is a clearly felt need in the art for a projectile launching device with no cam lean, having a first cam, a second cam, a launch string and one or two cables, collectively known as a harness system, where neither end of the cable is rigidly attached to the cam.

These and additional objects, advantages, features and benefits of the present invention will become apparent from the following specification.

BRIEF DESCRIPTION OF THE DRAWINGS

FIG. 3A is a top view of a first one-piece cam with round cable tracks of the present invention, wherein a transition portal is illustrated, wherein the cables do not anchor to the cam.

FIG. 3B is an exploded side view of a first one-piece cam with round cable tracks of the present invention, having an upper and lower cable track that is at least twice as wide as a width of the cables, and having bearings and a transition portal illustrated, wherein cables do not anchor to the cam.

FIG. 3C is a bottom view of a first one-piece cam with round cable tracks of the present invention, a transition portal is illustrated and wherein the cables do not anchor to the cam.

FIG. 3D is an exploded bottom side view of a first one-piece cam with round cable tracks of the present invention, having an upper and lower cable track that is at least twice as wide as the width of the cables, and having bearings and a transition portal is illustrated, wherein the cables do not anchor to the cam.

FIG. 3E is a top view of a second one-piece cam with round cable tracks of the present invention, a transition portal is illustrated and wherein the cables do not anchor to the cam.

FIG. 3F is an exploded side view of a second one-piece cam with round cable tracks of the present invention, having an upper and lower cable track that is at least twice as wide as a width of the cables, and having bearings and a transition portal is illustrated, wherein the cables do not anchor to the cam.

DETAILED DESCRIPTION OF THE PREFERRED EMBODIMENTS

Figure 1:
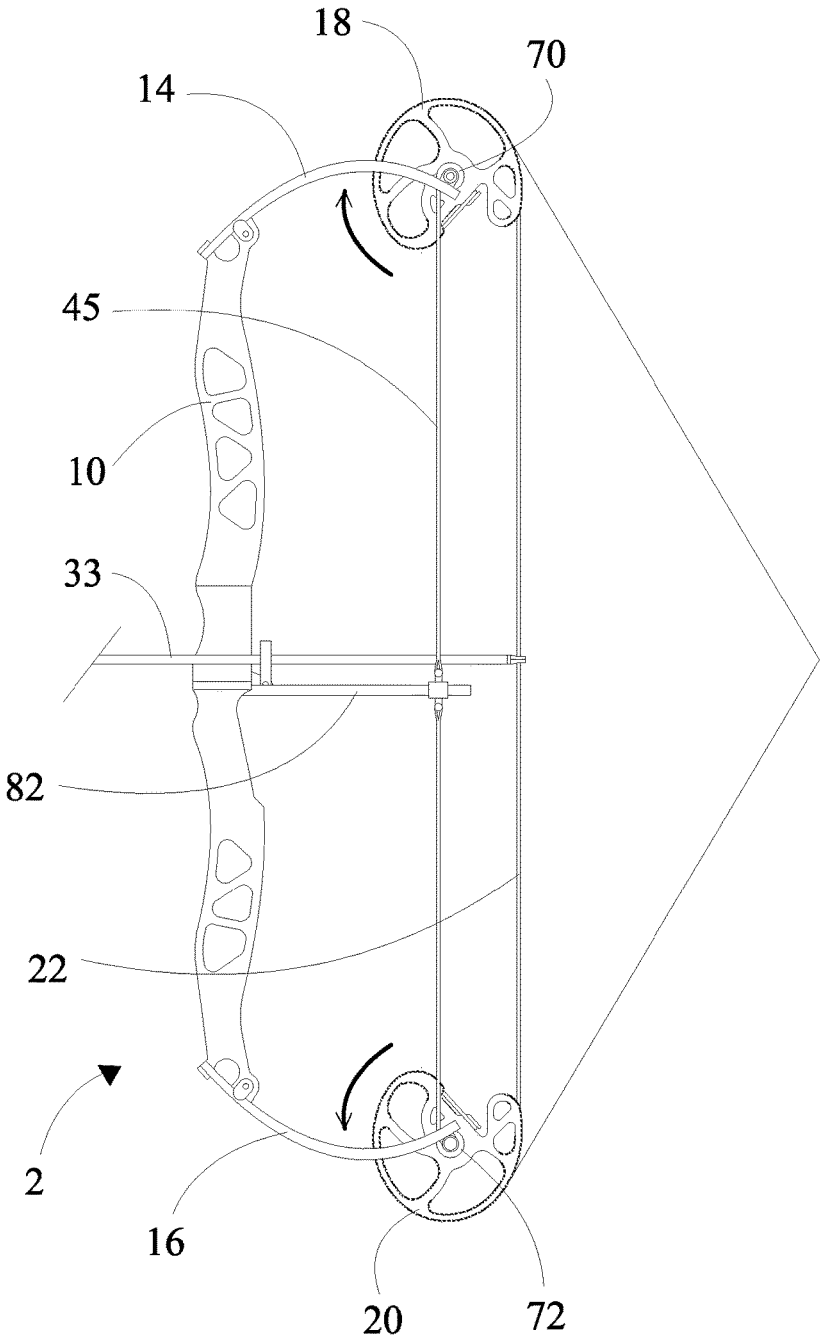
FIG. 1 is a side view of a vertical bow of the present invention, having a first and second cam, a first cable, and a string, wherein the cable does not anchor to the cam.
Figure 1A:
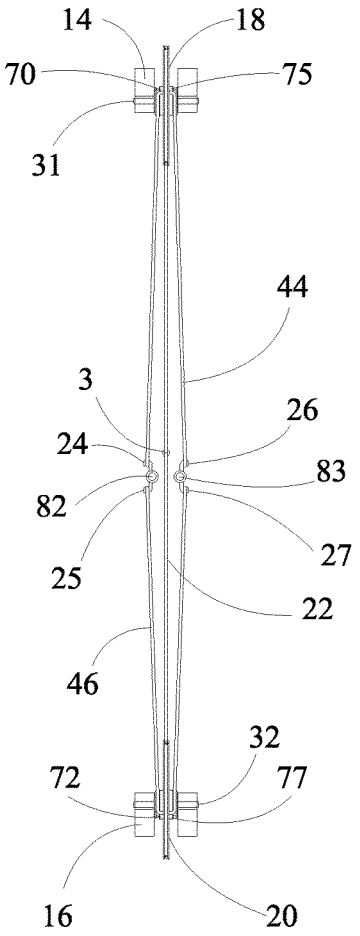
FIG. 1A is a partial rear view of a vertical bow of the present invention, having a first and second cam, a first and second cable, and a string, wherein the cables do not anchor to the cam.
Figure 1B:
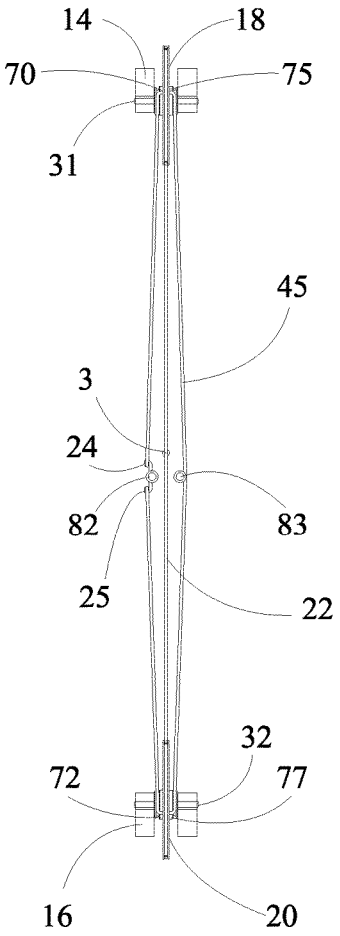
FIG. 1B is a partial rear view of a vertical bow of the present invention, having a first and second cam, a cable, and a string, wherein the cable does not anchor to the cam.

With reference now to the drawings, FIGS. 1, 1A and 1B show views of a vertical bow-type projectile launching device 2. The projectile launching device 2 preferably includes a bow riser 10, a first limb 14, a second limb 16, a first cam 18, a second cam 20 and a launch string 22. One end of the first limb 14 is attached to a first end of the bow riser 10 and one end of the second limb 16 is attached to a second end of the bow riser 10. The first cam 18 is pivotally retained on an opposing end of the first limb 14 with a first axle 31 and the second cam 20 is pivotally retained on an opposing end of the second limb 16 with a second axle 32.

With more specific reference to FIG. 1A, the disclosed embodiment illustrates a vertical bow 2 having a first cable 44 and a second cable 46, wherein a first end of the first cable 44 is anchored to a first cable first post 24, and a second end of the first cable 44 is anchored to a first cable second cable post 26. A first end of the second cable 46 is anchored to a second cable first cable post 25 and a second end of the second cable 46 is anchored to a second cable second post 27. A first cable spanner bar 82 is coupled to the riser 10 on a first side of the launch string 22, and a second cable spanner bar 83 is coupled to the riser 10 on a second side of the launch string 22. The cable spanner bars 82 and 83 displace the first and second cables 44 and 46 a distance away from the launch string 22 to allow clearance for an arrow 33.

With more specifically referring to FIG. 1B, the disclosed embodiment illustrates a vertical bow 2 having a single cable 45, wherein said first end of the single cable 45 the first post 24, and a second end of the single cable 45 is anchored to the cable post 25. The first spanner bar 82 is coupled to the riser 10 on the first side of the launch string 22, and the second spanner bar 83 is coupled to the riser 10 on the second side of the launch string 22. The first and second spanner bars 82, 83 displace the single cable 45 a distance away from the launch string 22 allow clearance for the arrow 33.

FIGS. 2 and 2A-2G illustrate a crossbow 1 of the current invention. The bow riser 10 may be joined with the rail 12 in any method known to join two pieces, as well as the rail 12 and the riser 10 being formed together as a single unit. The projectile launching device 1 preferably includes the riser 10, the rail 12, a first limb 14, a second limb 16, a first cam 18, a second cam 20 and a launch string 22.

Figure 2:
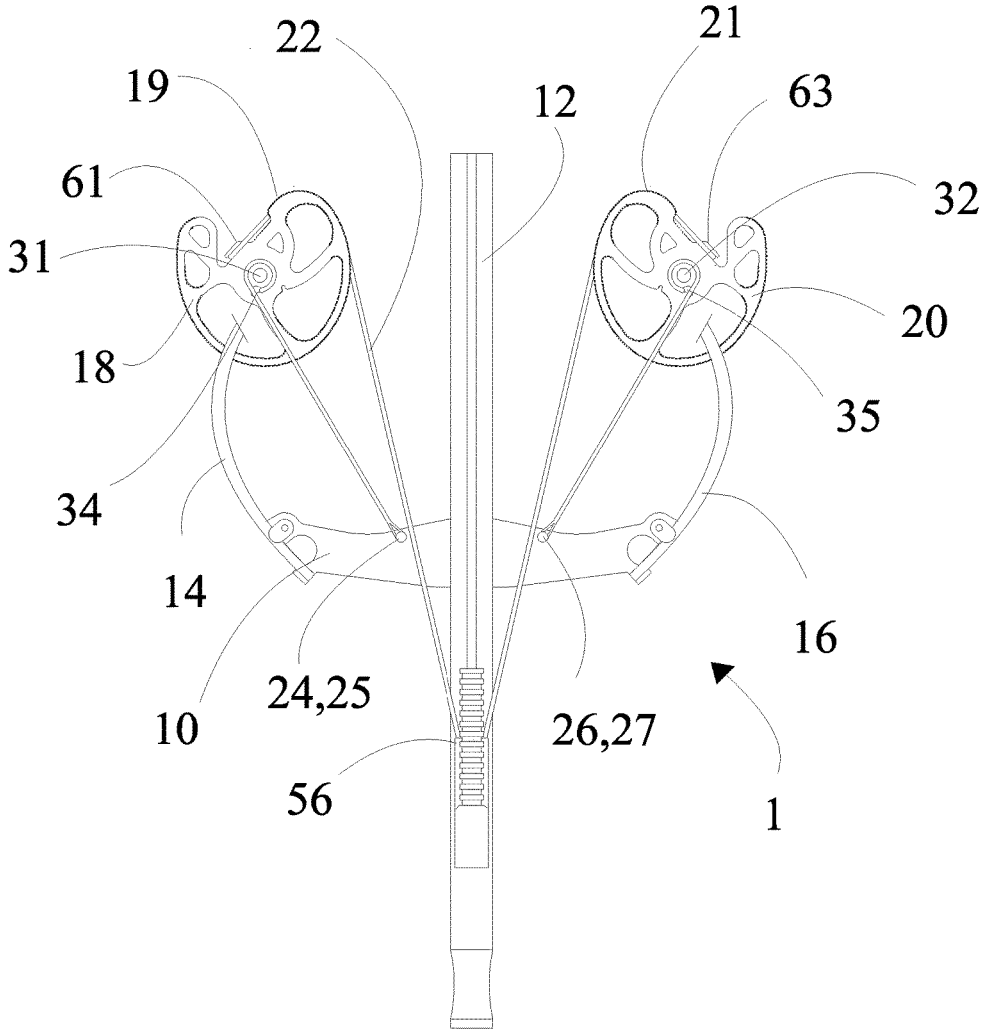
FIG. 2 is a top view of a reverse draw crossbow of the present invention in a cocked position, having first and second cams; first and second cables; and a string, wherein the ends of the limbs are cut away to illustrate the first and second cable wrapping the cam pulleys, wherein the cables do not anchor to the cam.
Figure 2A:
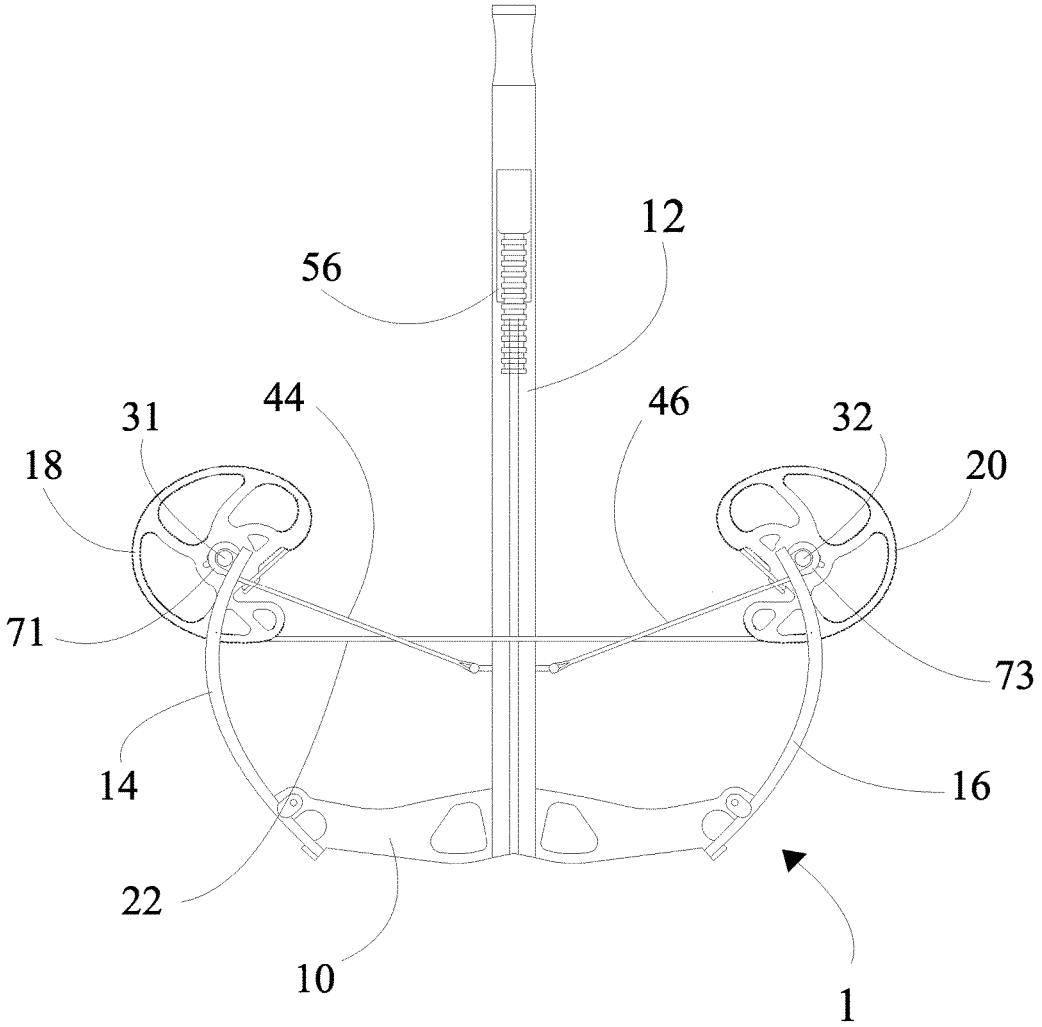
FIG. 2A is a top view of a conventional limb crossbow with inverted cams of the present invention in an at-rest position, having first and second cams; first and second cables; and a string, wherein the cables do not anchor to the cam.
Figure 2B:
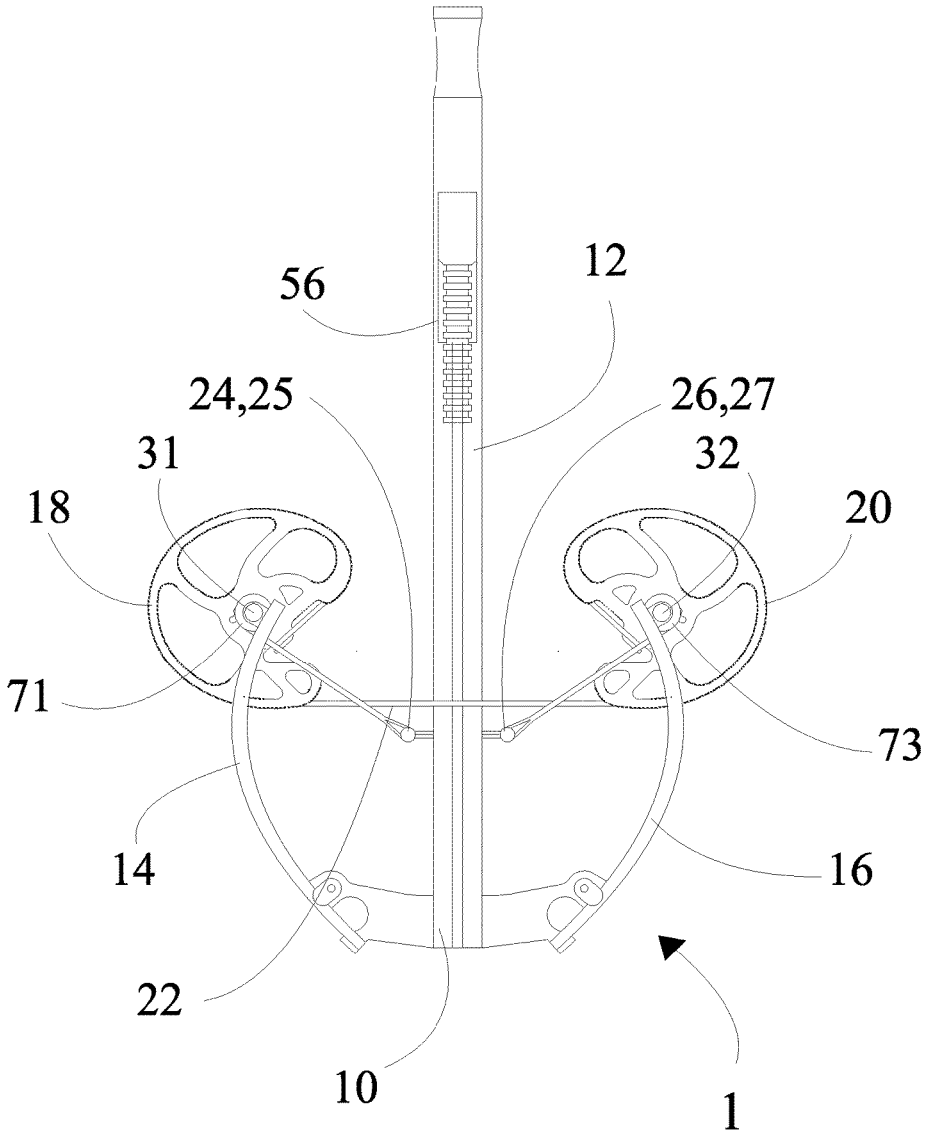
FIG. 2B is a top view of a compact conventional limb crossbow with inverted cams of the present invention in an at-rest position, having first and second cams; first and second cables; and a string, wherein the cables do not anchor to the cam.
Figure 2C:
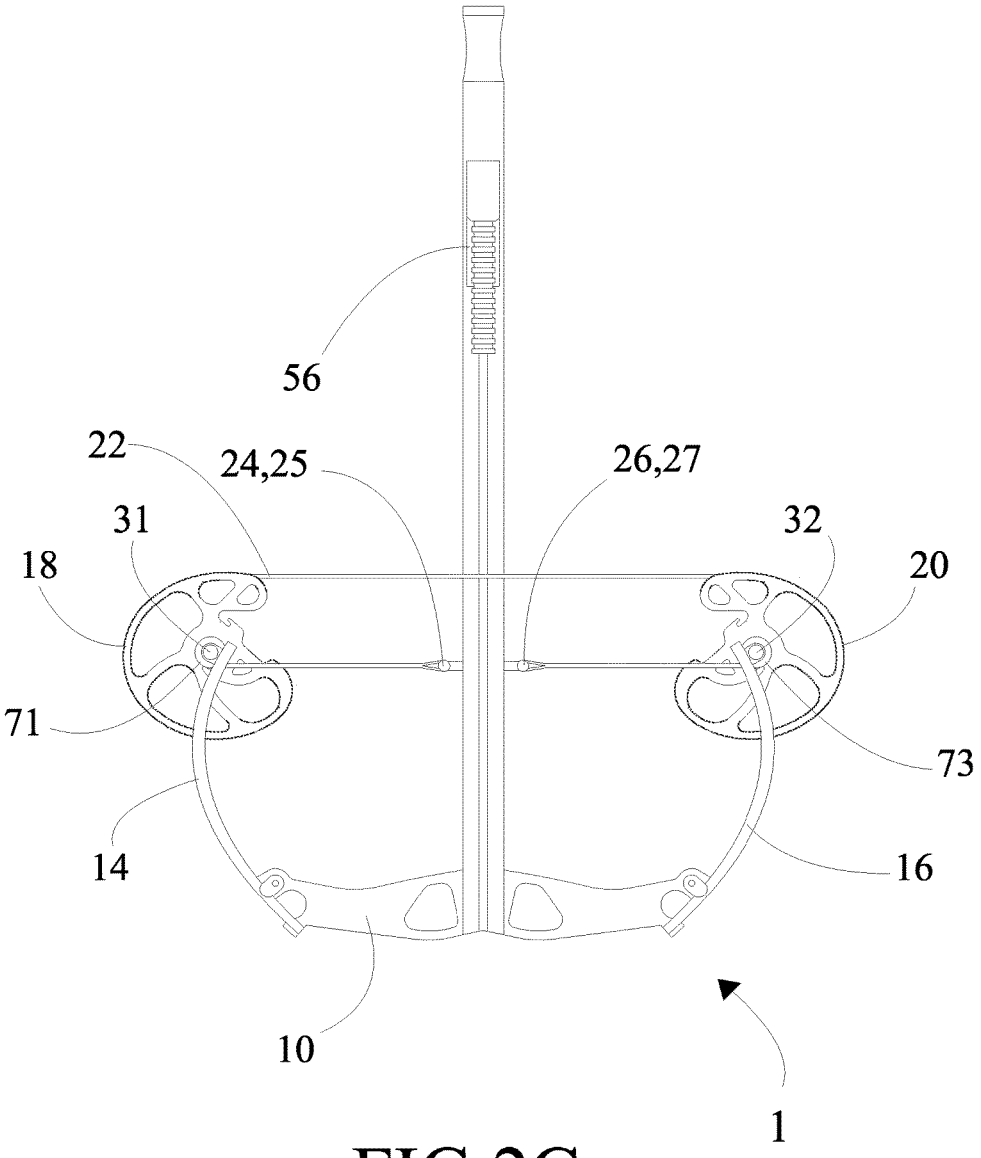
FIG. 2C is a top view of a conventional limb crossbow with conventional-draw cams of the present invention in an at-rest position, having first and second cams; first and second cables; and a string, wherein the cables do not anchor to the cam.
Figure 2D:
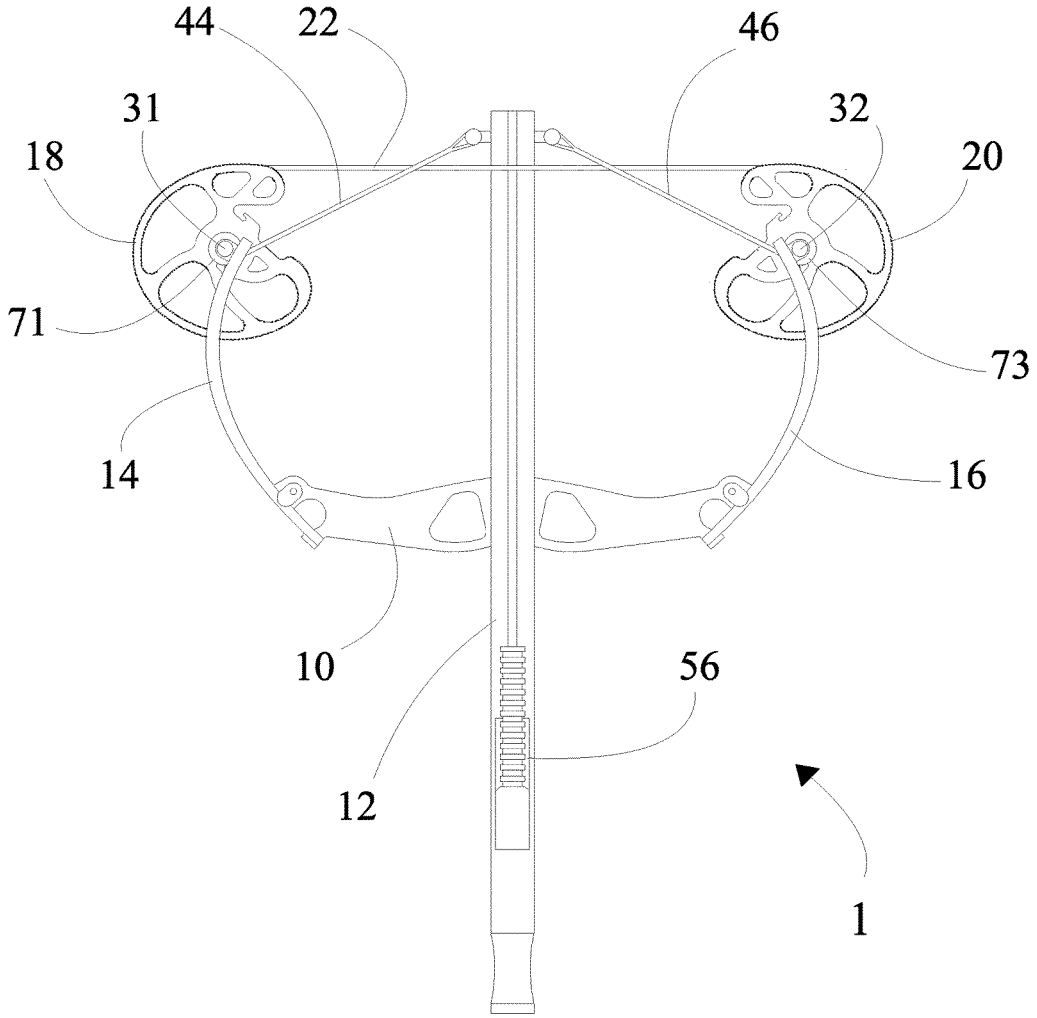
FIG. 2D is a top view of a reverse draw crossbow of the present invention in an at-rest position, having first and second cams; first and second cables; and a string, wherein the cables do not anchor to the cam.
Figure 2E:
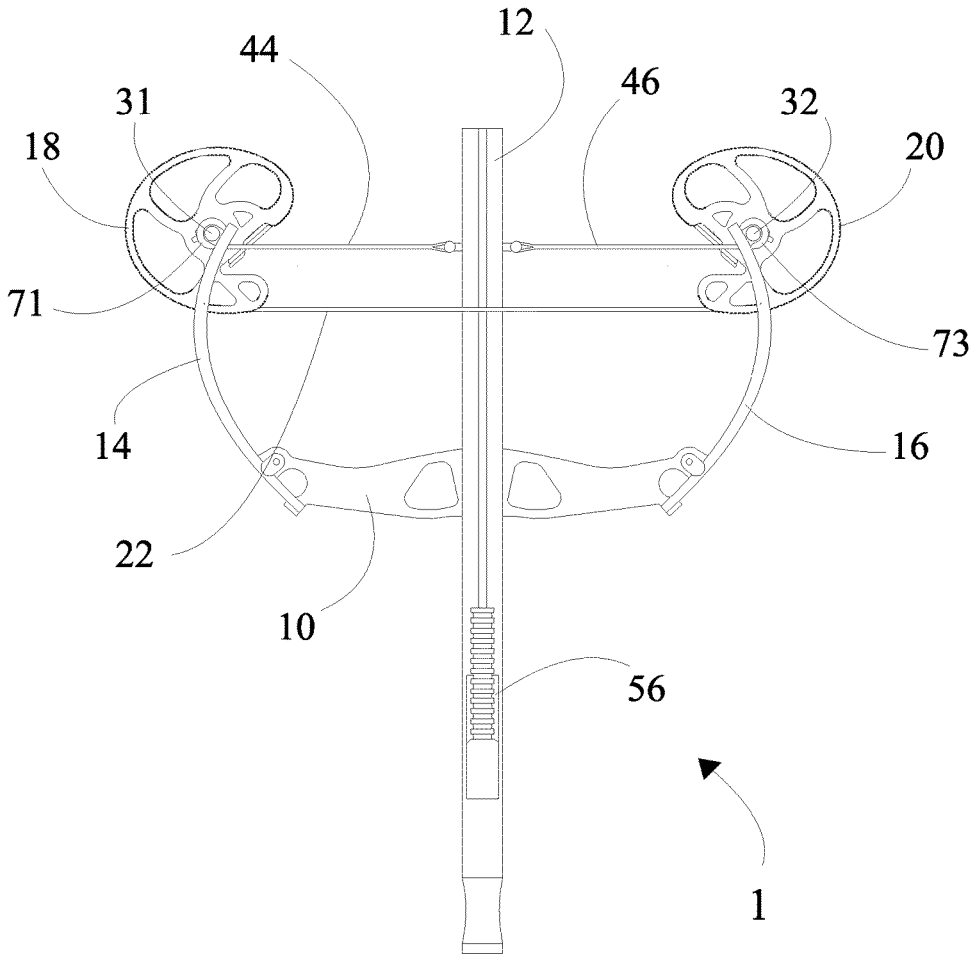
FIG. 2E is a top view of a reverse draw crossbow of the present invention in an at-rest position, having first and second cams; first and second cables; and a string, said string comes off a back side of the cam, wherein the cables do not anchor to the cam.
Figure 2F:
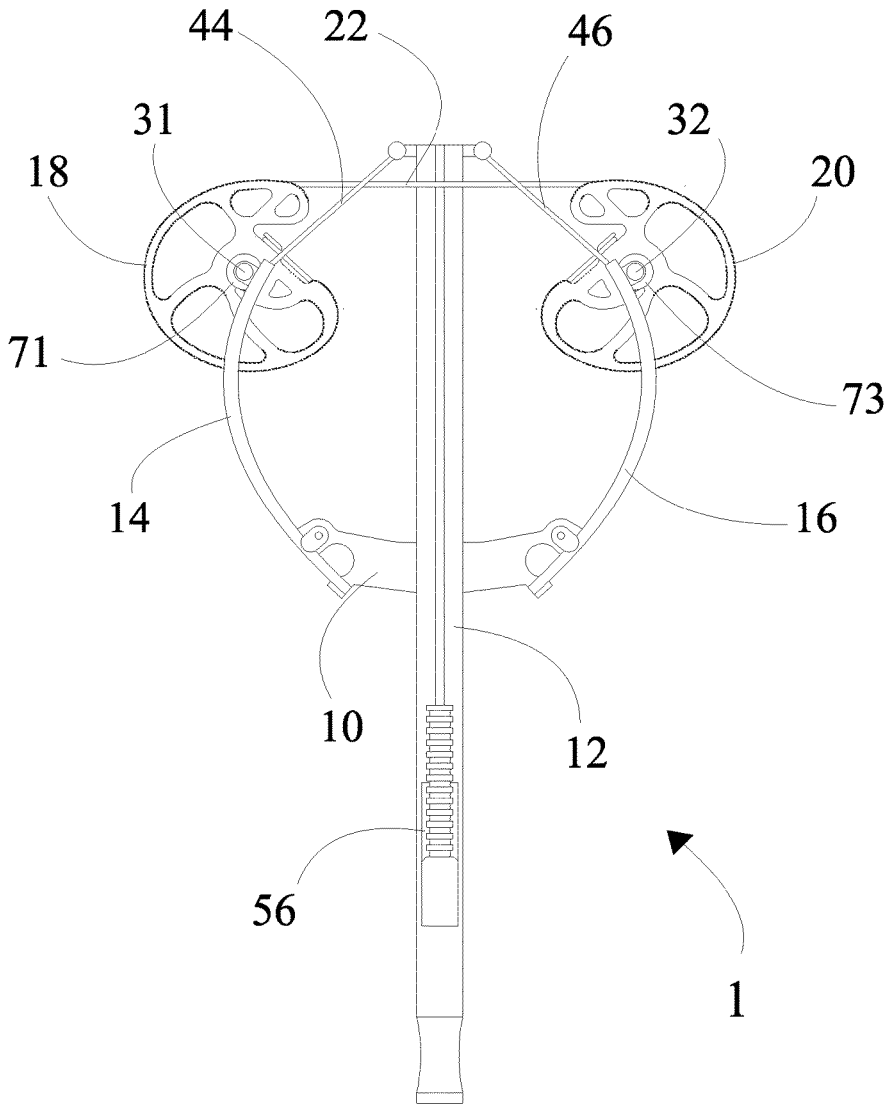
FIG. 2F is a top view of a compact reverse draw crossbow of the present invention in the at-rest position, having first and second cams; first and second cables; and a string, wherein the cables do not anchor to the cam.
Figure 2G:
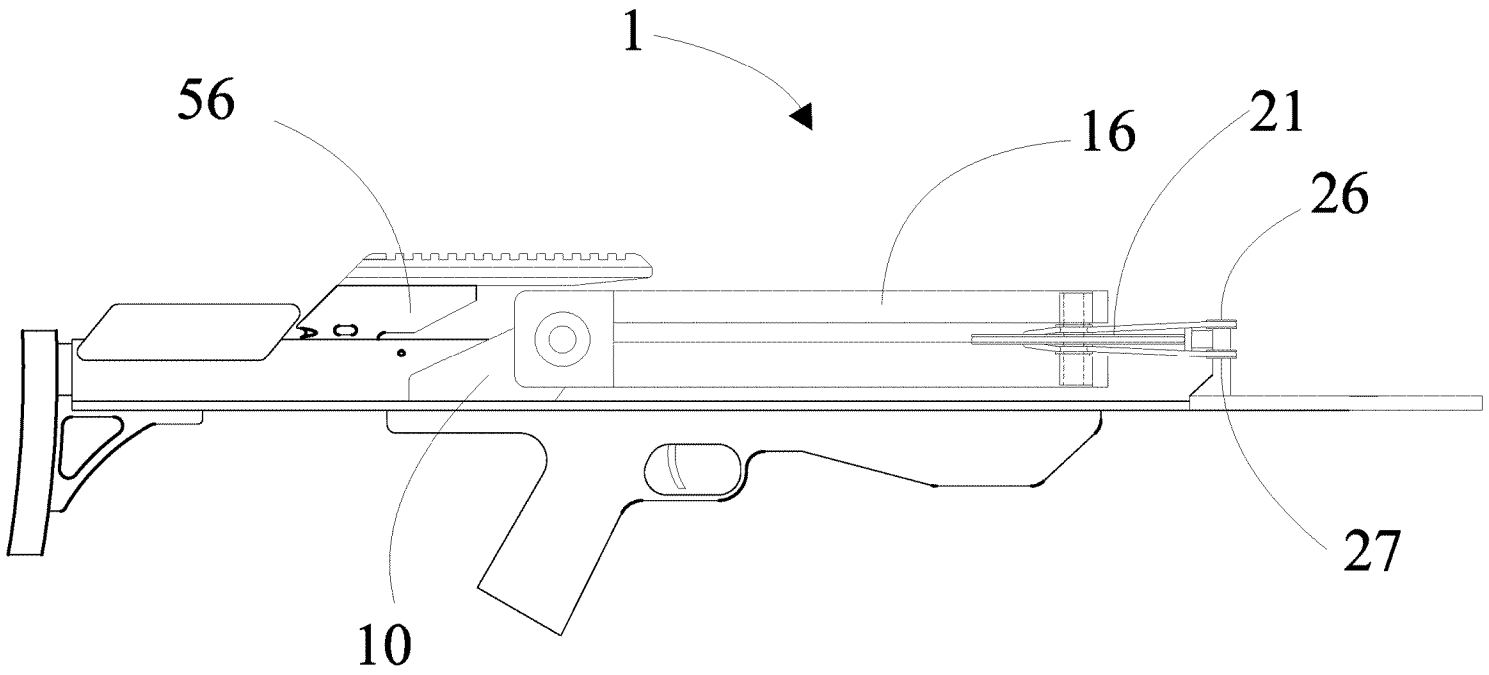
FIG. 2G is a side view of a reverse draw crossbow of the present invention in an at-rest position, having first and second cams; first and second cables; and a string, wherein the cables do not anchor to the cam.

A first end of the first limb 14 is coupled to a first end of the bow riser 10 and a first end of the second limb 16 is coupled to a second end of the bow riser 10. The first cam 18 is pivotally retained on an opposing end of the first limb 14 and the second cam 20 is pivotally retained on an opposing end of the second limb 16. The crossbow 1 includes a first cable 44 and a second cable 46. With reference to FIGS. 2 and 2G, the first end of the first cable 44 is anchored to the first cable first post 24 extending from a top of the riser 10. The second end of the first cable 44 is anchored to the first cable second cable post 25 extending from a bottom of the riser 10. The first end of the second cable 46 is anchored to the second cable first cable post 26 extending from a top of the riser 10. The second end of the second cable 46 is anchored to the second cable second post 27 extending from a bottom of the riser 10.

With reference to FIGS. 2B-2G, the first cable first post 24 extends from a first side of the rail 12, above a centerline of the rail 12. The first cable second post 25 extends from the first side of the rail 12, below the centerline of the rail 12. The second cable first post 26 extends from a second side of the rail 12, above the centerline of the rail 12. The second cable second post 27 extends from the second side of the rail 12, below the centerline of the rail 12.

With reference to FIGS. 3A-3D, the first cam 18 includes a first launch string track 19, a first cam upper cable track 40, a first cam launch string post 61, a first cam transitional portal 34, and a first cam lower cable track 41. With reference to FIGS. 3E-3G, the second cam 20 includes a second launch string track 21, a second cam upper cable track 42, a second cam launch string post 63, a second cam transitional portal 35, and a second cam lower cable track 43. A first end of the launch string 22 is retained by the first cam launch string post 61; a portion of the span of the launch string 22 at least partially wraps around the first cam 18 in the first cam launch string track 19; a portion of the span of the launch string 22 at least partially wraps the second cam 20 in the second cam launch string track 21, and a second end of the bowstring 22 is retained by the second cam launch string post 63.

The first end of the first cable 44 is coupled to the first cable first cable post 24; a segment of the first cable 44 partially engages the first cam upper cable track 40; the middle of the first cable 44 is inserted through the first cam transitional portal 34; a segment of the first cable 44 partially engages the first cam lower cable track 41; and the second end of the first cable 44 is coupled to the first cable second cable post 25. The first cable 44 does not cross the rail 12. A first end of the second cable 46 is coupled to the second cable first cable post 26; a segment of the second cable 46 partially engages the second cam upper cable track 42; the middle of the second cable 46 is inserted through the transitional portal 35; a segment of the second cable 46 partially engages the second cam lower cable track 43; and the second end of the second cable 46 is coupled to the second cable second cable post 27. The first and second cable first cable posts 24, 26 are located above a horizontal plane of the first and second cams 18, 20. The first and second cable second cable posts 25, 27 are located below a horizontal plane of the first and second cams 18, 20. The second cable 46 does not cross the rail 12.

Figure 6A:
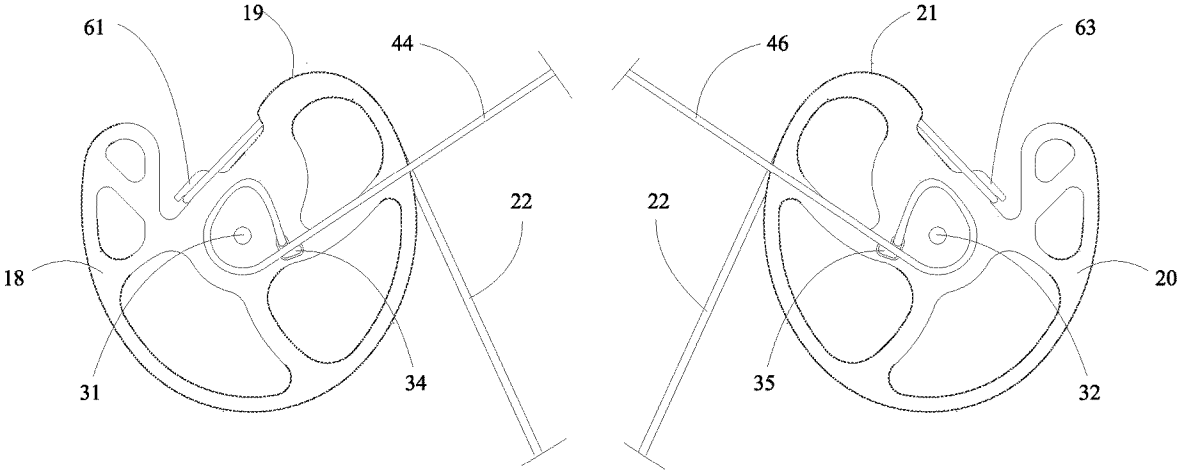
FIG. 6A is a top view of first and second multi-piece cams with non-circular cable tracks of the present invention; having an upper and lower cable track that is at least twice as wide as a width of the cables, and a transition portal is illustrated, modules have been removed for illustrative purposes; a string and cable are illustrated with the cam in a drawn position, wherein the cables do not anchor to the cam.
Figure 6B:
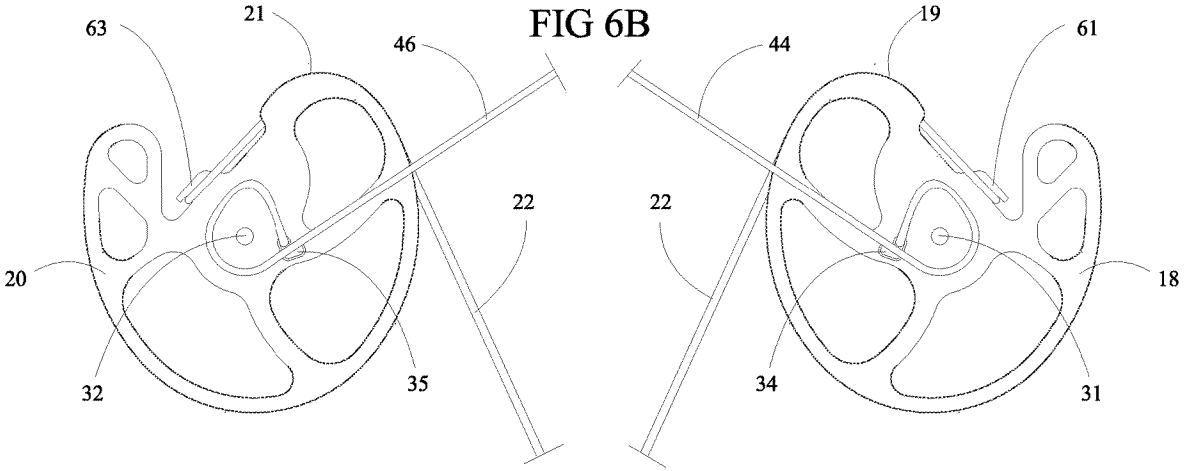
FIG. 6B is a bottom view of first and second multi-piece cams with non-circular cable tracks of the present invention, having an upper and lower cable track that is at least twice as wide as a width of the cables, and a transition portal is illustrated; modules have been removed for illustrative purposes; a string and cable are illustrated with the cam in a drawn position, wherein the cables do not anchor to the cam.

With reference to FIGS. 6A and 6B, when the launch string 22 is drawn from a rest position to a ready to fire position, the first cam 18 rotates in a first direction, and the second cam 20 rotates in a second direction. As the cams 18 and 20 rotate, the launch string 22 is unwound from the first and second launch string tracks 19 and 21. Simultaneously, the cables 44 and 46 wind into the first and second upper cable tracks 40 and 42 and the first and second lower cable tracks 41 and 43 of the first 18 and second 20 cams. When the launch string 22 has been drawn to the ready-to-fire position, it may be held in this the position by an operably releasable catch located in a housing 56. The first cable 44 is slideable relative to the first cam transitional portal 34 and the second cable 46 is slideable relative to the second cam transitional portal 35. An alternate embodiment uses the launch string 22 and a single cable 45. With reference to FIG. 1B, a first end of the single cable 45 is attached to the single cable first cable post 24, a span of the single cable 45 is retained in the first cam transitional portal 34 of the first cam 18; crosses a center-line of the rail 12; is retained in the second cam transitional portal 35 of the second cam 20, and the second end of the single cable 45 is attached to the single cable second cable post 25. The single cable 45 replaces first and second cables 44, 46.

FIGS. 3A-3H illustrate an embodiment of a cam of the current invention, without string and cable(s), wherein the cam is constructed of a unitary type construction. In this type of construction, the first and second side of the first cam 18 and the second cam 20 are mirror images of each other, and the first cam 18 is identical and interchangeable with the second cam 20. Specifically, FIG. 3A is a top view of the first cam 18; FIGS. 3B and 3D is a side view of a first cam 18; and FIG. 3C is a bottom view of a first cam 18. FIG. 3E is a top view of the second cam 20; FIGS. 3F and 3H are side views of the second cam 20; and FIG. 3G is a bottom view of the second cam 20. The upper cable track 40, the lower cable track 41, the upper cable track 42 and the lower cable track 43 may be generally circular, or non-circular.

Figure 4A:
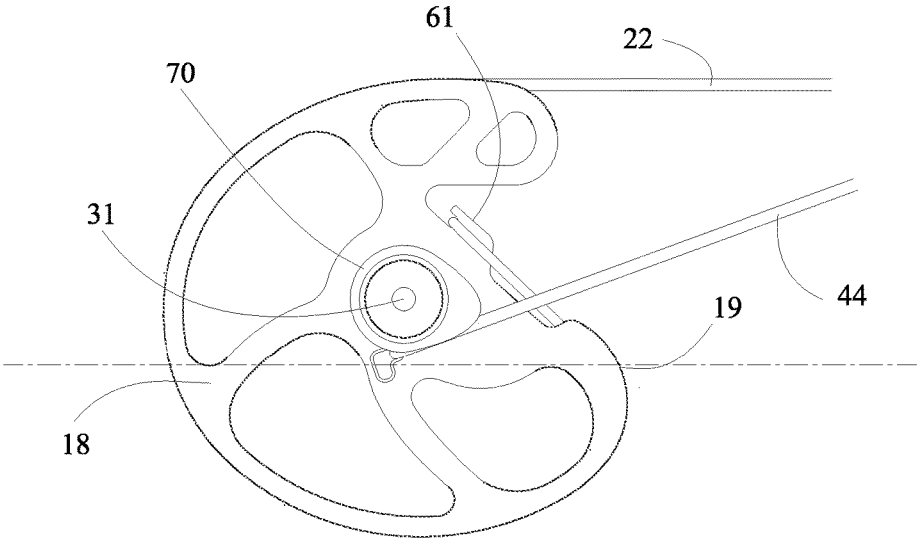
FIG. 4A is a top view of a first multi-piece cam with non-circular cable tracks of the present invention, a transition portal is illustrated; a string and cable are illustrated with the cam, wherein the cables do not anchor to the cam.
Figure 4B:
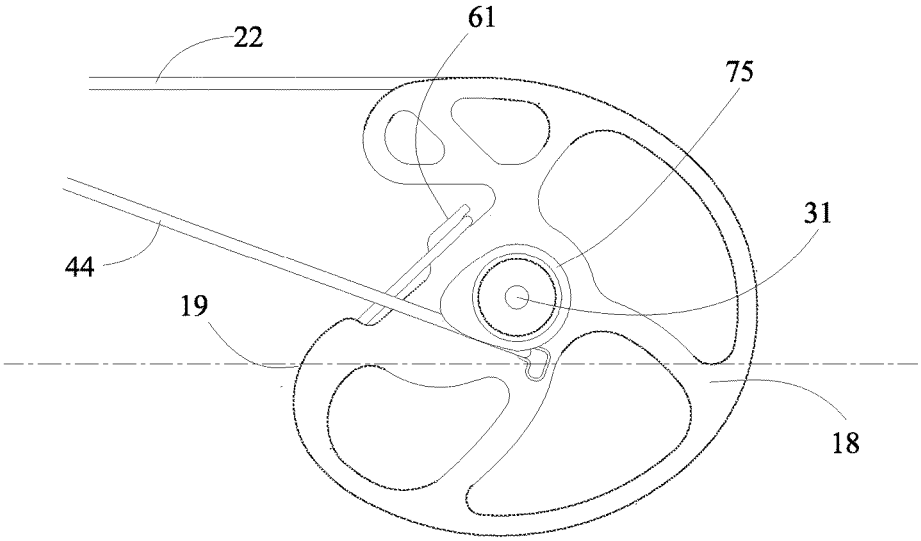
FIG. 4B is a bottom view of a first multi-piece cam with non-circular cable tracks of the present invention, a transition portal is illustrated; a string and cable are illustrated with the cam, wherein the cables do not anchor to the cam.
Figure 4F:
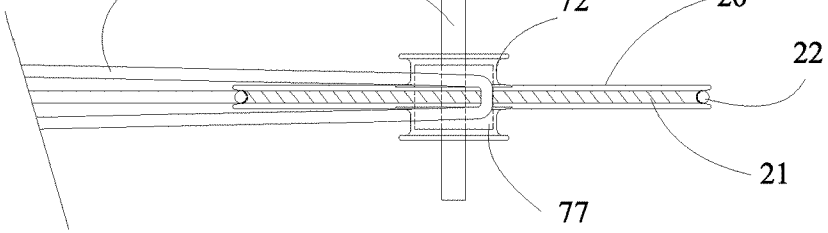
FIG. 4F is an exploded side view of a second multi-piece piece cam with non-circular cable tracks of the present invention having an upper and lower cable track that is at least twice as wide as a width of the cables, and having first and second mirror image modules and a transition portal illustrated, wherein the cables do not anchor to the cam.
Figure 4D:
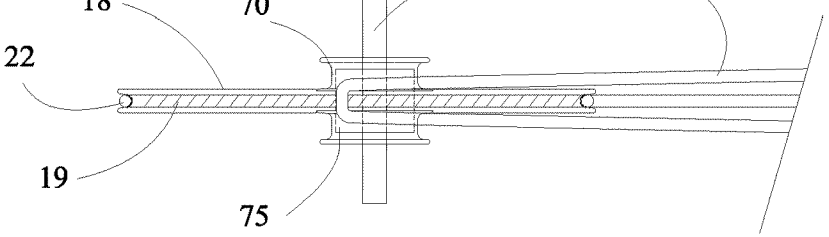
FIG. 4D is an exploded side view of a first multi-piece piece cam with non-circular cable tracks of the present invention having an upper and lower cable track that is at least twice as wide as a width of the cables, and having first and second mirror image modules and a transition portal illustrated, wherein the cables do not anchor to the cam.
Figure 4E:
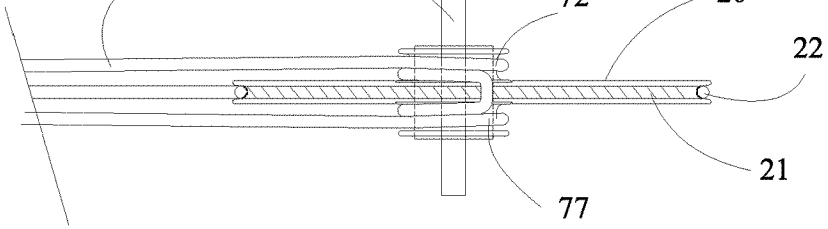
FIG. 4E is a side cut-away view of a second multi-piece cam with non-circular cable tracks of the present invention, having an upper and lower cable track that is at least twice as wide as a width of the cables, and a transition portal is illustrated with first cable transitioning from a first side of the cam to a second side of the cam, a string and cable are illustrated with the cam, wherein the cable does not anchor to the cam.
Figure 4C:
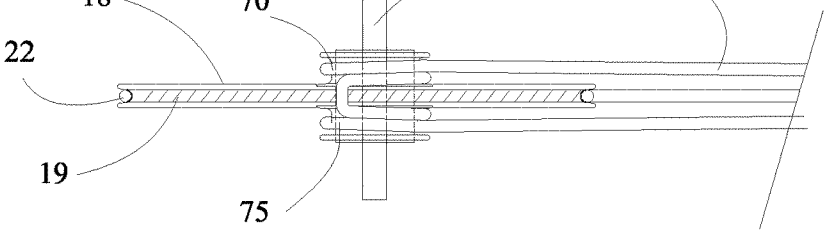
FIG. 4C is a side cut-away view of a first multi-piece cam with non-circular cable tracks of the present invention, having an upper and lower cable track that is at least twice as wide as a width of the cables, and a transition portal is illustrated with first cable transitioning from a first side of the cam to a second side of the cam, a string and cable are illustrated with the cam, wherein the cable does not anchor to the cam.
Figures 4G, 4H, 4I, 4J:
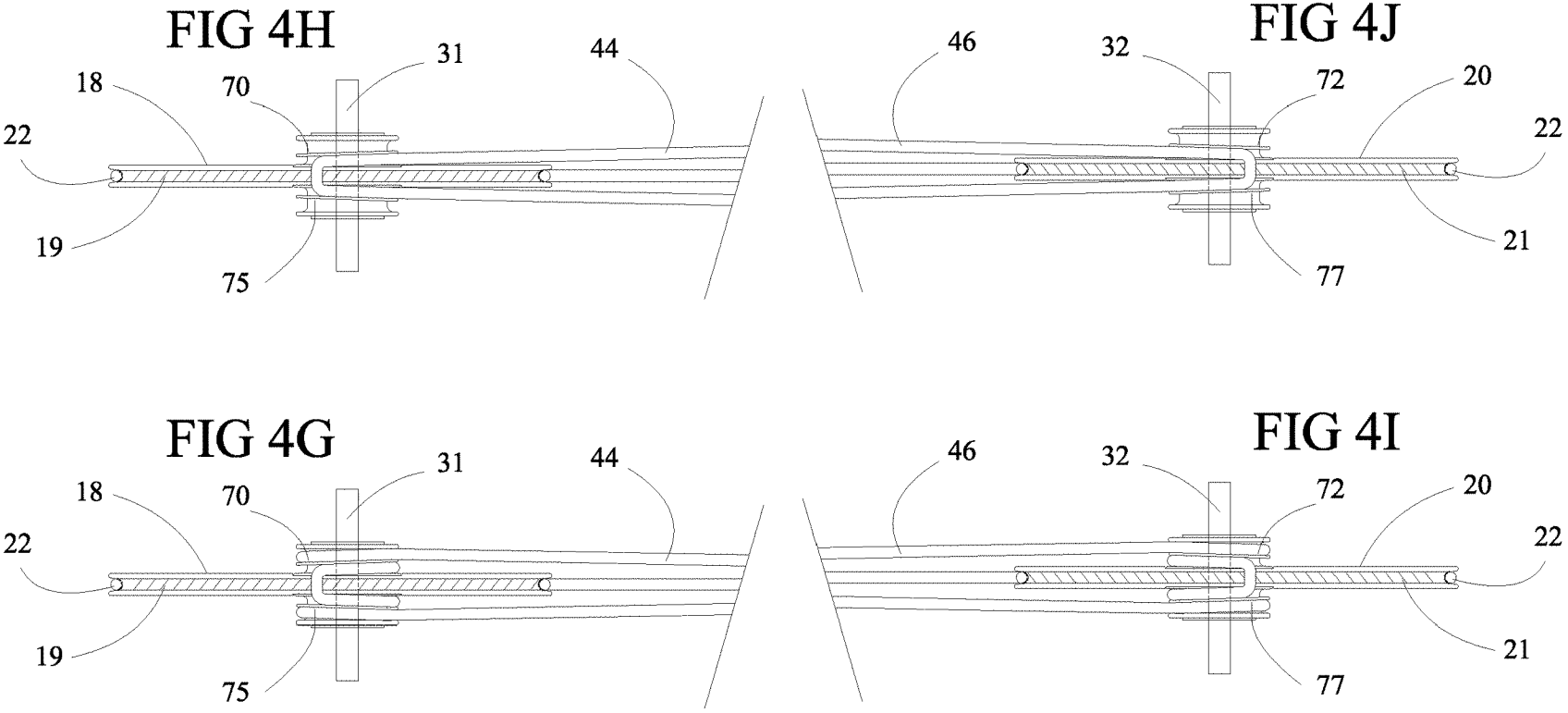
FIG. 4G is a side cut-away view of a first multi-piece cam with non-circular cable tracks of the present invention, having an upper and lower helical cable track, and a transition portal is illustrated with first cable transitioning from a first side of the cam to a second side of the cam, a string and cable are illustrated with the cam, wherein the cable does not anchor to the cam.
FIG. 4H is an exploded side view of a first multi-piece piece cam with non-circular cable tracks of the present invention having an upper and lower helical cable track, and having first and second mirror image modules and a transition portal illustrated, wherein the cables do not anchor to the cam.
FIG. 4I is a side cut-away view of a second multi-piece cam with non-circular cable tracks of the present invention, having an upper and lower helical cable track, and a transition portal is illustrated with first cable transitioning from a first side of the cam to a second side of the cam, a string and cable are illustrated with the cam, wherein the cable does not anchor to the cam.
FIG. 4J is an exploded side view of a second multi-piece piece cam with non-circular cable tracks of the present invention having an upper and lower helical cable track, and having first and second mirror image modules and a transition portal illustrated, wherein the cables do not anchor to the cam.

FIGS. 4A-4D and 5A-5D illustrate an embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first module 70 and a second module 75. The first and second modules 70, 75 are mirror images of each other. The first and second modules 70, 75 are identical and are interchangeable with a first module 72 and a second module 77 of the second cam 20. Specifically, FIG. 4A is a top view of the first cam 18, FIG. 4B is a bottom view of the first cam 18, FIG. 4C is a cut-away view of the first cam 18 with the string 22 and the cable 44. The first module 70 and the second module 75 may be generally non-circular, or circular. FIG. 4C illustrates how the cable 44 passes through the first transitional portal 34.

FIGS. 4G-4J illustrate an alternate embodiment of the first cam 18 of the current invention with string and cable(s), wherein the first cam 18 includes a modular type construction. In this type of construction, the first and second side of the first cam 18 and the second cam 20 are mirror images of each other, and the first cam 18 is identical and interchangeable with the second cam 20. The first cam 18 includes a first helical module 70 and a second helical module 75. The first and second helical modules 70, 75 are mirror images of each other. The first and second helical modules 70, 75 are identical and are interchangeable with a first module 72 and a second module 77 of the second cam 20. The first and second helical modules 70, 75 include tracks that cause the cable to wrap into spiral or helix form.

Figure 5A:
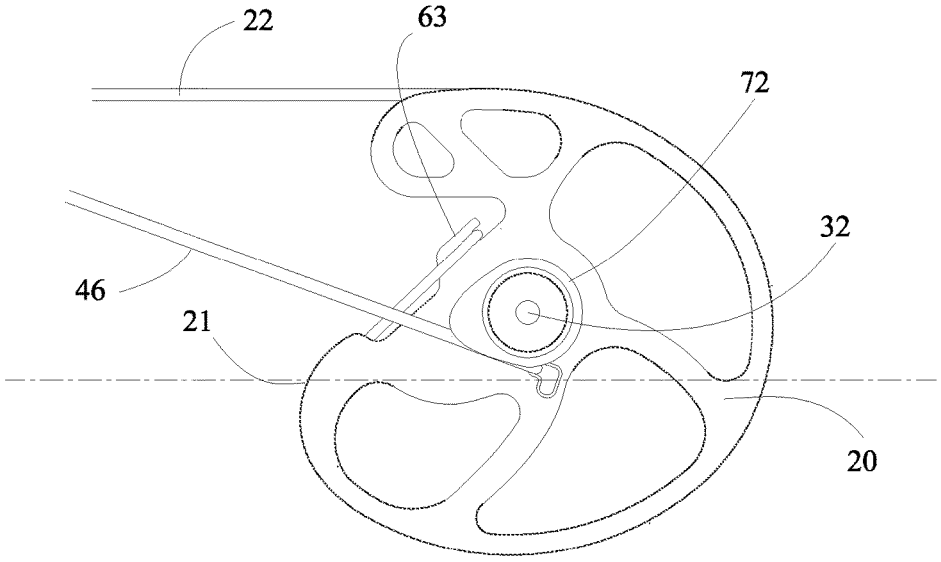
FIG. 5A is a top view of a second multi-piece cam with non-circular cable tracks of the present invention, the transition portal is illustrated; a string and cable are illustrated with the cam, wherein the cables do not anchor to the cam.
Figure 5B:
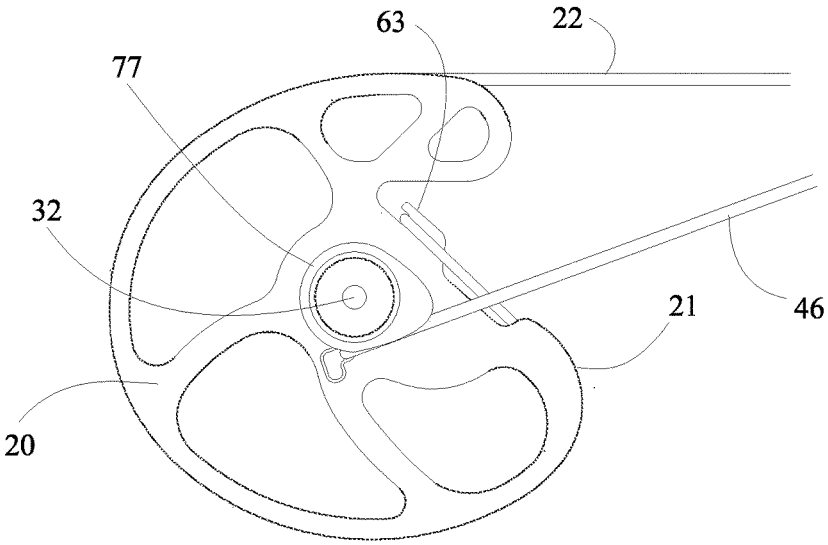
FIG. 5B is a bottom view of a second multi-piece cam with non-circular cable tracks of the present invention, the transition portal is illustrated; a string and cable are illustrated with the cam, wherein the cables do not anchor to the cam.
Figure 5C:
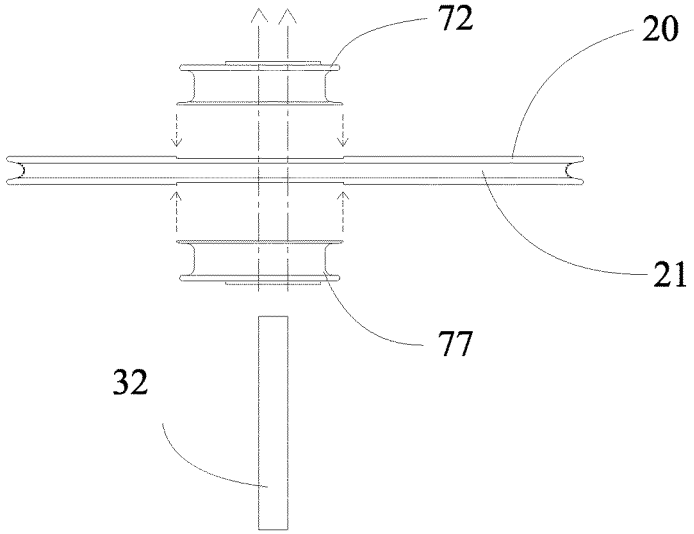
FIG. 5C is an exploded side view of a second multi-piece piece cam with non-circular cable tracks of the present invention having an upper and lower cable track that is at least twice as wide as a width of the cables, and having a first and second mirror image modules; a transition portal is illustrated, wherein the cables do not anchor to the cam.
Figure 5D:
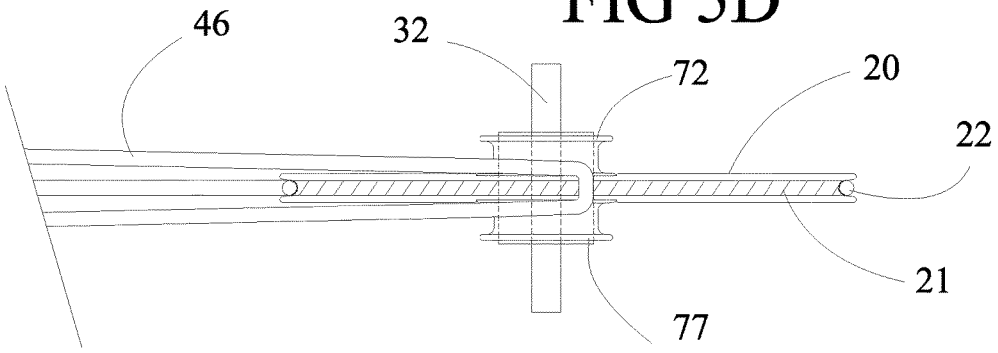
FIG. 5D is a side cut-away view of a second multi-piece cam with non-circular cable tracks of the present invention, having an upper and lower cable track that is at least twice as wide as a width of the cables, and a transition portal is illustrated with first cable transitioning from a first side of the cam to a second side of the cam; a string and cable are illustrated with the cam, wherein the cable does not anchor to the cam.
Figure 5E:
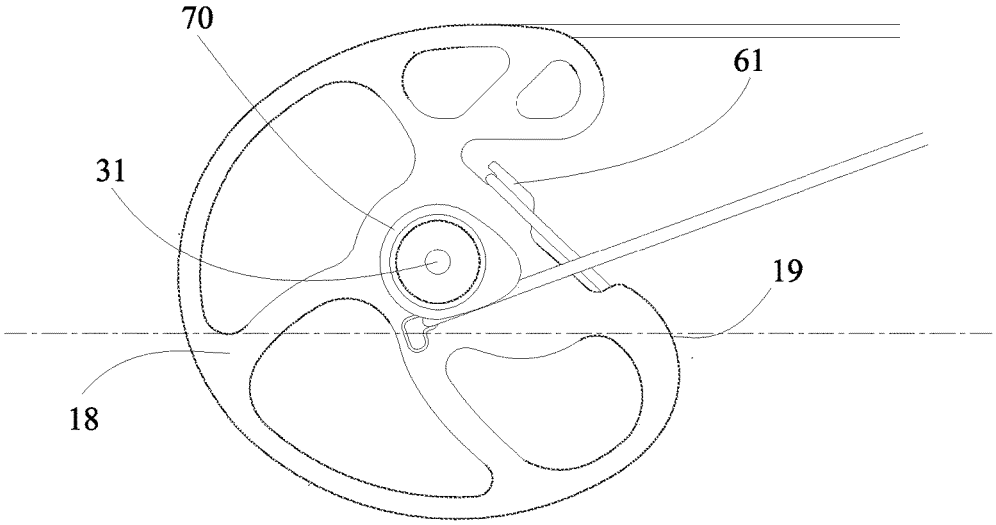
FIG. 5E is a top view of a first multi-piece cam with non-circular cable tracks of the present invention, the transition portal is illustrated; a string and cable are illustrated with the cam, wherein the cables do not anchor to the cam.
Figure 5F:
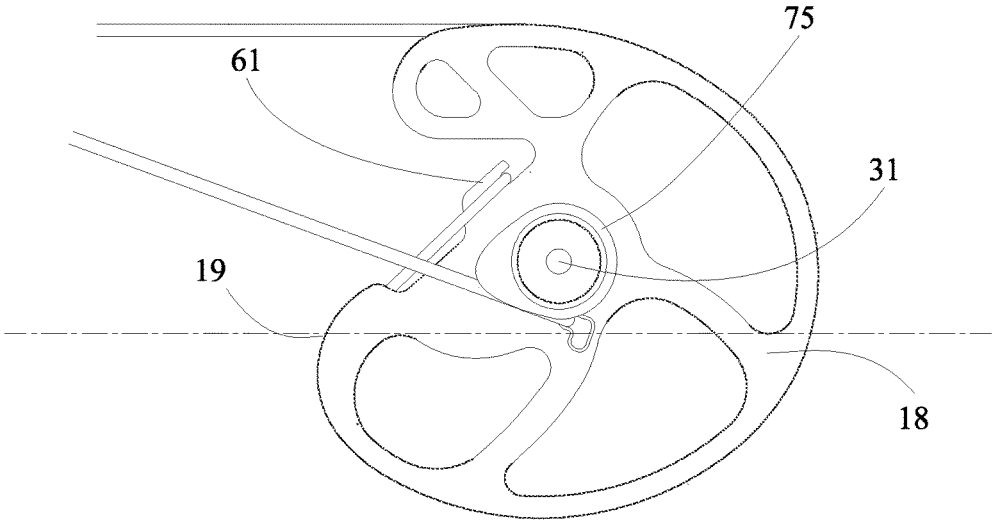
FIG. 5F is a bottom view of a first multi-piece cam with non-circular cable tracks of the present invention, the transition portal is illustrated; a string and cable are illustrated with the cam, wherein the cables do not anchor to the cam.
Figure 5G:
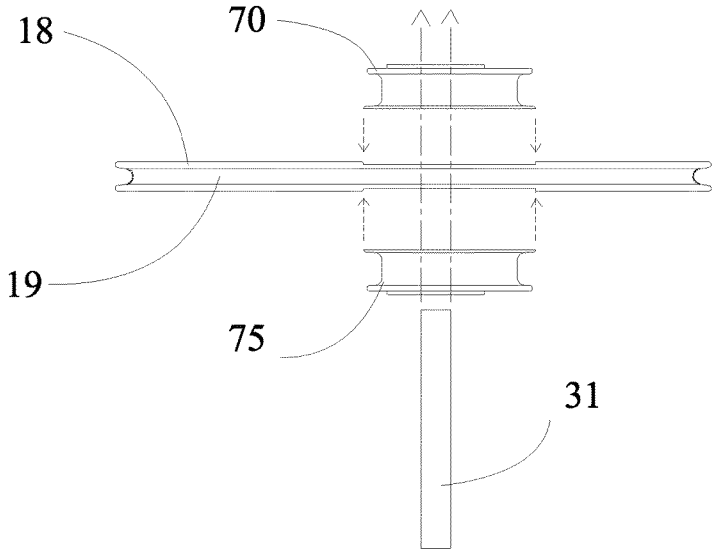
FIG. 5G is an exploded side view of a first multi-piece piece cam with non-circular cable tracks of the present invention having an upper and lower cable track that is at least twice as wide as a width of the cables, and having a first and second mirror image modules; a transition portal is illustrated, wherein the cables do not anchor to the cam.
Figure 5H:
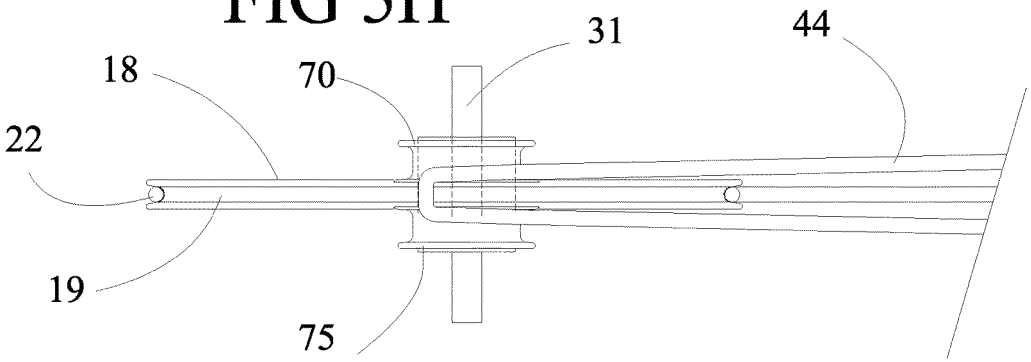
FIG. 5H is a side cut-away view of a first multi-piece cam with non-circular cable tracks of the present invention, having an upper and lower cable track that is at least twice as wide as a width of the cables, and a transition portal is illustrated with first cable transitioning from a first side of the cam to a second side of the cam; a string and cable are illustrated with the cam, wherein the cable does not anchor to the cam.

FIGS. 5A-5D illustrate an embodiment of the second cam 20 of the current invention, with string and cable(s), wherein the second cam 20 is constructed of a modular type construction. In this type of construction, the first and second side of the second cam 20 and the first cam 18 are mirror images of each other, and the first cam 18 is identical and interchangeable with the second cam 20. The first module 72 and the second module 77 are mirror images of each other, and the first and second modules 70 and 75 are identical and interchangeable with the first and second modules 72 and 77. Specifically, FIG. 5A is a top view of the second cam 20, FIG. 5B is a bottom view of the second cam 20, FIG. 5C is a cut-away view of a second cam with the string 22 and the cable 46. The first module 72 and the second cable module 77 may be generally non-circular, or circular. FIG. 5D illustrates how the cable 44 passes through the first transitional portal 35.

FIG. 6A illustrates a top view of the first cam 18 and the second cam 20, in the drawn position. FIG. 6B illustrates a bottom view of the first cam 18 and the second cam 20, in the drawn position. FIGS. 6A and 6B are identical to each other and not just mirror images, as described previously in FIGS. 5A-5D. This feature allows for an easier method of manufacture and assembly. With reference to FIGS. 2 and 2G, a first end of the first cable 44 is anchored to a first cable first cable post 24; the second end of the first cable 44 is passed through the first cam transitional portal 34; and anchored to the first cable second cable post 25. A first end of the second cable 46 is anchored to a second cable first cable post 26; the second end of the second cable 46 is passed through the second cam transitional portal 35; and anchored to the second cable second cable post 27. A first end of the launch string 22 is anchored to the first cam string post 61; a segment of the launch string 22 partially wraps cam 18 in the string track 19; the string crosses the center of the riser 10; and partially wraps the second cam 20 in the string track 21; and the second end of the launch string 22 is anchored to the second cam string post 63.

With reference to FIGS. 4A-4D and 5A-5D, the center of the first and second cables 44, 46 slideably engage the first and second transitional portals 34, 35, which allows the first and second cables 44, 46 to "self-center" themselves relative to a first side and a second side of the first and second cams 18 and 20. The self-centering feature of the cables 44, 46 provides for automatic cable timing, which eliminates cam lean, and timing issues. As the launch string 22 is drawn, the launch string unwraps, or "pays out" from the first and second cams 18, 20. Simultaneously, the first and second cables 44, 46 wrap the respective first cable tracks 70, 75 and the second cable tracks 72, 77.

With reference to FIGS. 3A-3G, it is preferable for both single and double cable designs that a vertical distance between the lower cable tracks 41, 43 relative to the string launch tracks 19, 21 have an equal vertical distance as the upper cable tracks 40, 42 relative to the string launch track 19, 21. However, the projectile launching device 1 could still function satisfactorily without the above vertical distance conditions. It is also preferable that the cables 44, 45, 46 not be parallel to the launch string 22. However, the projectile launching device 1 will function satisfactorily without the non-parallel conditions. It is preferable that the first ends of the first and second cables 44, 46 not be anchored to the same post. However, the first and second cables 44, 46 will still function satisfactorily if anchored to the same post. It is preferable that the second ends of the first and second cables 44 and 46 not be anchored to the same post. However the first and second cables 44, 46 will still function satisfactorily if anchored to the same post.

While the preferred embodiment of the invention has been illustrated and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A projectile launching device comprising:

a first 3-track cam and a second 3-track cam capable of being coupled by a launch string and at least one cable, said first and second 3-track cams have a middle launch string track, a first cable track is located on a first side of said middle launch string track, said first cable track having a width at least twice as wide as a width of said at least one cable, a second cable track is located on a second side of said middle launch string track, said second cable track having a width at least twice as wide as a width of said at least one cable, wherein an inner most perimeter shape of said first cable track is the same as said second cable track, said first and second cable tracks are parallel to said launch string track, said first 3-track cam and said second 3-track cam are identical, wherein said at least one cable passes through said first 3-track cam and said second 3-track cam.

2. The projectile launching device of claim 1 wherein:

a distance between a center line of said first cable track and said middle launch string track is the same as a distance between a center line of said second cable track and said middle launch string track.

3. The projectile launching device of claim 1 wherein:

a first end of the launch string is anchored to said first 3-track cam and a second end of the launch string is anchored to said second 3-track cam.

4. The projectile launching device of claim 1 wherein:

said first cable is slideably engaged with said first 3-track cam, said second cable is slideably engaged with said second 3-track cam.

5. The projectile launching device of claim 1 wherein:

said first cable track is a first cable track module, said second cable track is a second cable track module.

6. The projectile launching device of claim 1 wherein:

said projectile launching device is a crossbow.

7. A projectile launching device comprising:

a first 3-track cam and a second 3-track cam capable of being coupled by a launch string, a first cable and a second cable, said first and second 3-track cams have a middle launch string track, a first cable track is located on a first side of said middle launch string track, a second cable track is located on a second side of said middle launch string track, wherein an inner most perimeter shape of said first cable track is the same as said second cable track, said first and second cable tracks are parallel to said launch string track, said first 3-track cam and said second 3-track cam are identical, said first cable track and said second cable track is at least twice a width of said first cable and said second cable, a first end of said launch string is anchored to said first 3-track cam and a second end of said launch string is anchored to said second 3-track cam, a first end of said first cable is anchored to a first cable first post, a first segment at least partially wraps said first cable track of said first 3-track cam, a mid-segment of said first cable passes through said first 3-track cam, a second segment of said first cable at least partially wraps said second cable track of said 3-track cam, a second end of said first cable is anchored to a first cable second post, a first end of said second cable is anchored to a second cable first post, a first segment of said second cable at least partially wraps said first cable track of said second 3-track cam, a mid-segment of said second cable passes through said second 3-track cam, a second segment of said second cable at least partially wraps said cam second cable track of said second 3-track cam, a second end of said second cable is anchored to a second cable second post.

8. The projectile launching device of claim 7 wherein:

said projectile launching device is a crossbow.

9. A projectile launching device comprising:

a first 3-track cam and a second 3-track cam capable of being coupled by a launch string and a cable, said first and second 3-track cams have a middle launch string track, a first cable track is located on a first side of said middle launch string track, a second cable track is located on a second side of said middle launch string track, wherein an inner most perimeter shape of said first cable track is the same as said second cable track, said first and second cable tracks are parallel to said launch string track, said first cam and said second 3-track cam are identical, a first end of said launch string is anchored to said first 3-track cam, a second end of said launch string is anchored to said second 3-track cam, a first end of said cable is anchored to a first cable post, a first segment of said cable at least partially wraps said first cable track of said first cam, a next segment of said cable passes through said first 3-track cam, a next segment of said cable at least partially wraps said second cable track of said first cam, a next segment of said cable at least partially wraps said second cable track of said second 3-track cam, a next segment of said cable passes through said second 3-track cam, a next segment of said cable at least partially wraps said first cable track of said second 3-track cam, a second end of said cable is anchored to a second cable post.

10. The projectile launching device of claim 9 wherein:

said projectile launching device is a crossbow.

11. A projectile launching device comprising:

a first 3-track cam and a second 3-track cam capable of being coupled by a launch string and at least one cable, said first and second 3-track cams have a middle launch string track, a first helical cable track is located on a first side of said middle launch string track, a second helical cable track is located on a second side of said middle launch string track, wherein an inner most perimeter shape of said first cable track is the same as said second cable track, said first and second cable tracks have the same axis of rotation as said middle launch string track, said first 3-track cam and said second 3-track cam are identical, wherein said cable is capable of wrapping around said first and said second cable tracks; and said at least one cable includes a first cable and a second cable, said first cable passes through said middle launch string track of said first 3-track cam, said second cable passes through said middle launch string track of said second 3-track cam.

12. The projectile launching device of claim 11 wherein:

a distance between a center line of said first cable track and said middle launch string track is the same as a distance between a center line of said second cable track and said middle launch string track.

13. The projectile launching device of claim 11 wherein:

a first end of the launch string is anchored to said first 3-track cam and a second end of the launch string is anchored to said second 3-track cam.

14. The projectile launching device of claim 11 wherein:

said at least one cable includes a first cable and a second cable, said first cable track is a first cable track module, said second cable track is a second cable track module.

15. The projectile launching device of claim 11 wherein:

said projectile launching device is a crossbow.

16. A projectile launching device comprising:

a first 3-track cam and a second 3-track cam capable of being coupled by a launch string, a first cable and a second cable, said first and second 3-track cams have a middle launch string track, a first helical cable track is located on a first side of said middle launch string track, a second helical cable track is located on a second side of said middle launch string track, wherein an inner most perimeter shape of said first helical cable track is a mirror image of said second helical cable track, said first 3-track cam and said second 3-track cam are identical, a first end of said launch string is anchored to said first 3-track cam and a second end of said launch string is anchored to said second 3-track cam, a first end of said first cable is anchored to a first cable first post, a first segment at least partially wraps said first cam first helical cable track, a mid-segment of said first cable passes through said middle launch string track of said first 3-track cam, a second segment of said first cable at least partially wraps a second helical cable track of said first 3-track cam, a second end of said first cable is anchored to a first cable second post, a first end of said second cable is anchored to a second cable first post, a first segment of said second cable at least partially wraps a first helical cable track of said second 3-track cam, a mid-segment of said second cable passes through a middle launch string track of said second 3-track cam, a second segment of said second cable at least partially wraps a second helical cable track of said second 3-track cam, a second end of said second cable is anchored to a second cable second post.

17. The projectile launching device of claim 16 wherein: said projectile launching device is a crossbow.

* * * * *